United States Patent [19]

Stumpf

[11] Patent Number: 4,683,658

[45] Date of Patent: Aug. 4, 1987

[54] MANUALLY CONTROLLABLE MACHINE SUCH AS A FABRIC CUTTING MACHINE

[75] Inventor: Gunter O. Stumpf, Bad Urach, Fed. Rep. of Germany

[73] Assignee: Gunter O. Stumpf GmbH & Co. KG, Mehrstetten, Fed. Rep. of Germany

[21] Appl. No.: 707,053

[22] Filed: Mar. 1, 1985

[30] Foreign Application Priority Data

Apr. 9, 1984 [DE] Fed. Rep. of Germany ..... 3413346

[51] Int. Cl.[4] ..... B26B 7/00

[52] U.S. Cl. ..... 30/275; 83/925 CC; 180/125

[58] Field of Search ..... 30/273–275; 180/125; 104/23 FS, 134; 414/676; 83/925 CC, 431, 374; 244/105, 106, 23 R, 23 A, 23 B, 23 C

[56] References Cited

U.S. PATENT DOCUMENTS 3,437,168 4/1969 Grassl ..... 180/125

3,457,874 7/1969 Tezuka et al. ..... 180/125

FOREIGN PATENT DOCUMENTS 10573 of 1903 United Kingdom ..... 30/275

*Primary Examiner*—Douglas D. Watts

*Attorney, Agent, or Firm*—Scully, Scott, Murphy and Presser

[57] ABSTRACT

A manually controllable machine for cutting out or notching fabric has a supporting foot (2) for supporting the machine on a cutting table (). The foot (2) has a flat face (15) on which the machine rests. To reduce the effort required to displace the machine, at least one opening (25) of at least one channel (16 to 21) is provided in the face (15), the channel (16 to 21) being connected to a source of compressed air.

12 Claims, 6 Drawing Figures

FIG. 2
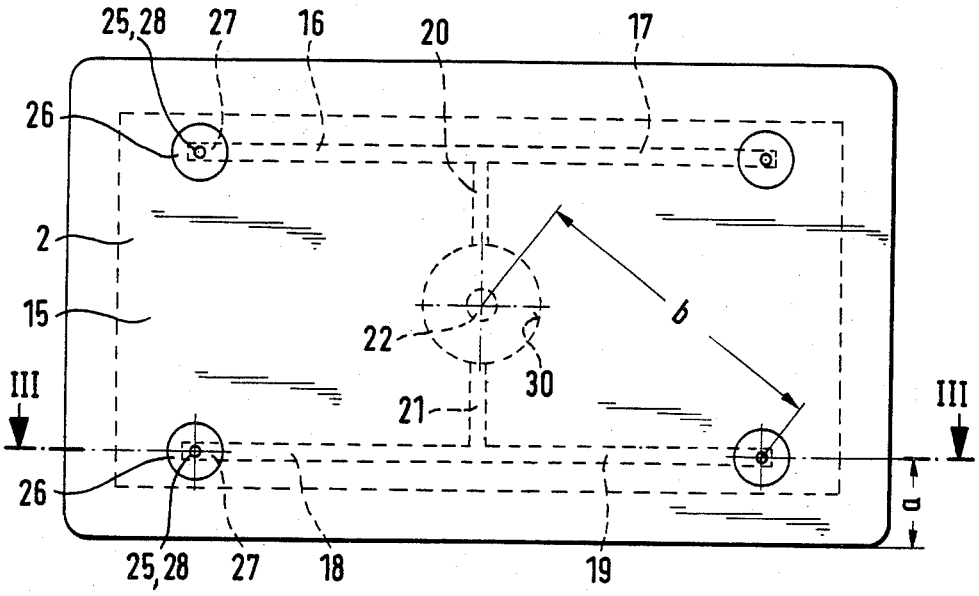
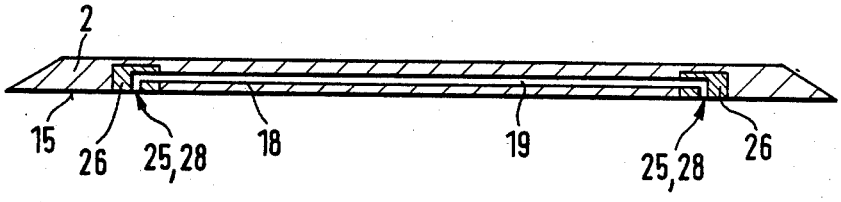
FIG. 3

FIG. 5
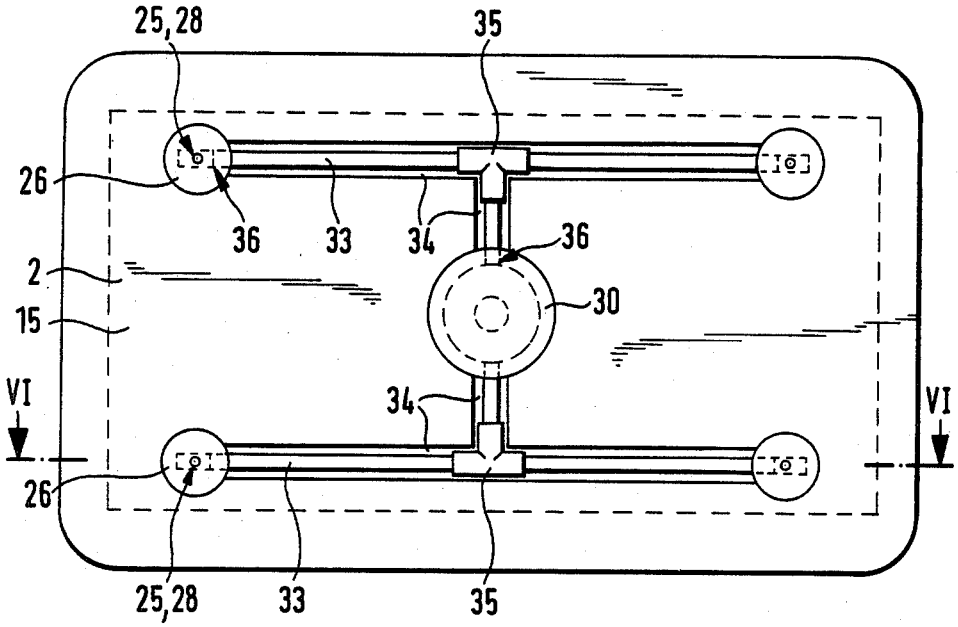
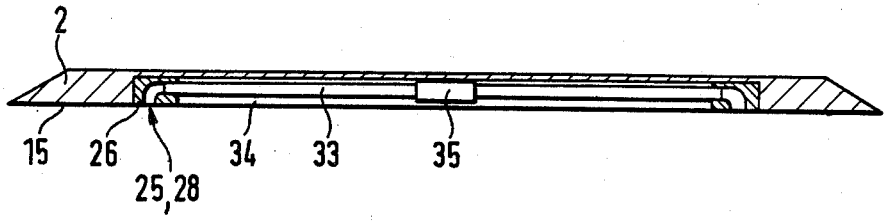
FIG. 6

MANUALLY CONTROLLABLE MACHINE SUCH AS A FABRIC CUTTING MACHINE

FIELD OF THE INVENTION

This invention relates to a manually controllable processing machine, such as a machine for cutting or notching fabric.

BACKGROUND OF THE INVENTION AND PRIOR ART

A machine of this type is described and illustrated in German Utility Model No. 19 70 523. The known machine is a manually controllable machine for cutting out layers of fabric on a cutting table. The machine comprises a supporting foot which may be displaced over the cutting table and which has an upwardly directed support or column, upon which a cutting element with its own drive is mounted. A handle is secured directly or indirectly to the support or column for displacing the machine over the cutting table in order to cut layers of fabric lying on the cutting table. The layers of fabric are then engaged from below by the supporting foot so that the layers of fabric slide over the supporting foot when the machine is displaced.

The operator has to apply a considerable force in order to displace the machine on the cutting table. In order to reduce this required force, the supporting foot was provided with rollers, which reduce the friction which has to be overcome by the pushing force. However, the maneuverability or the turning mobility of the machine on the cutting table was adversely affected. In addition, the arrangement of rollers necessitates a considerable overall height for the supporting foot and this conflicts with the demand to make the supporting foot as thin as possible so that the layers of material are lifted as little as possible when the supporting foot passes beneath them.

It is possible to achieve a reduced pushing force and, at the same time, sufficient maneuverability or satisfactory turning of the machine by using balls instead of rollers, but this increases wear on account of the point contact. Also, the roller bearing is impaired by fluff, and these two effects tend to result in an increased pushing force.

SUMMARY OF THE INVENTION

According to the present invention there is provided a manually controllable processing machine having a supporting foot for supporting the machine on a fabric cutting table, the supporting foot having a flat face in which is provided an opening of a passage which is connected to a compressed air source.

A machine in accordance with the present invention can be displaced and maneuvered easily on the cutting table.

The construction of a machine in accordance with the present invention leads to a whole series of advantages. In the first instance, both the static friction and the sliding friction are reduced on account of the air cushion which forms between the flat face and the cutting table. For this reason only a very small pushing force is required to shift the machine.

As the air cushion supports the machine, the weight of the machine has less influence on the required pushing force. For this reason it is possible to use heavier materials (i.e. materials of greater specific gravity) for the structural components of the machine, whereby the costs of production of the machine can be reduced.

A machine constructed in accordance with the present invention can not only be shifted easily on account of the air cushion, but can also be maneuvered and turned easily, because the effective friction between the sliding surfaces is very low. A further advantage is that the vibration of the motor, for driving a cutter of the machine, is damped by means of the air cushion, because there is no direct connection between the supporting foot and the cutting table.

The present invention also makes it possible for the supporting foot to be very thin so that easy underrunning of the layers of fabric is possible. This advantageous result is achieved because the outgoing air at the edge of the supporting foot counteracts the bearing weight of the layers of material.

Another advantageous effect of the present invention is that fluff and small remnants do not collect underneath the supporting foot, as in known machines, but are removed from the supporting foot by the radially diffusing flow of air.

A machine in accordance with the present invention will operate well with only one opening in the face of the supporting foot. It is recommended that this opening be arranged not at the center of gravity of the machine or rather not in the center of the face, since this would cause the machine to be unstable because the compressed air could escape at one side, while the other side of the supporting foot, without the formation of an air cushion, could contact the cutting table. However, a single opening which avoids this problem, for example an annular opening which is spaced from and encircles the center of gravity or the centre of the supporting foot, can be realized.

Preferably, a plurality of openings are provided. Also a plurality of channels may be provided all connected to a common compressed air source.

It is necessary for the openings to be some distance away from the edge of the supporting foot so that the compressed air does not escape too easily towards the edge and a pressure and thus an air cushion are created towards the centre of the face of the supporting foot. The ratio of the distance of each opening to the edge to the distance from each opening to the centre of gravity of the machine or the centre of the face of of the supporting foot is preferably approximately 1:2 to 1:4. The measurements have been determined through tests and they guarantee even air cushion formation underneath the face.

It has also become apparent that when using quadrangular bases the air cushion formation is good when the openings are situated on the diagonals.

Preferably the channels are arranged in the shape of an H, which is not just advantageous for quadrangular bases and which can be simply and easily achieved, for example by drilling, while avoiding comparatively long holes. If channels extend parallel to the face of the supporting foot, it is then possible for the supporting foot to be very low in terms of height.

The openings are preferably constituted by nozzles formed in fittings which are recessed into the face of the supporting foot. This makes it possible to meter the compressed air emerging from the openings in a simple manner. Also, the channels themselves can be made larger and so can be made more easily. In addition, no precision is required when forming the channels. However, exact dimensioning of the nozzles can be achieved in a simple manner when making the fitting. Replacement of the fittings by ones having different nozzle sizes makes it possible to adjust the centre of gravity of the machine.

It is convenient to connect all of the channels to a common supply line which extends longitudinally through a support extending from the supporting foot. Not only is expense spared by providing a common supply line, but also only a slight reduction in the cross-sectional area of the support or the column is required.

Preferably a shut-off valve is provided to shut off the compressed air, this being advantageous when the machine is idle not only for energy-saving reasons, but also so that the machine is prevented from creeping along the cutting table, for example on account of vibrations. As soon as the compressed air is shut off, the friction between the face of the supporting foot and the cutting table is increased. Automatic creeping of the processing machine is then prevented. The provision of a shut-off valve is also advantageous if during a cutting-out operation the machine is to stop at a certain point.

BRIEF DESCRIPTION OF THE DRAWINGS

FIG. 2 is a bottom view of the machine of FIG. 1;

FIG. 3 is a section taken on the line III—III in FIG. 2;

FIG. 5 is a bottom view of another fabric cutting machine; and

FIG. 6 is a section taken on the line VI—VI in FIG. 5.

DETAILED DESCRIPTION OF PREFERRED EMBODIMENTS

Figure 1:
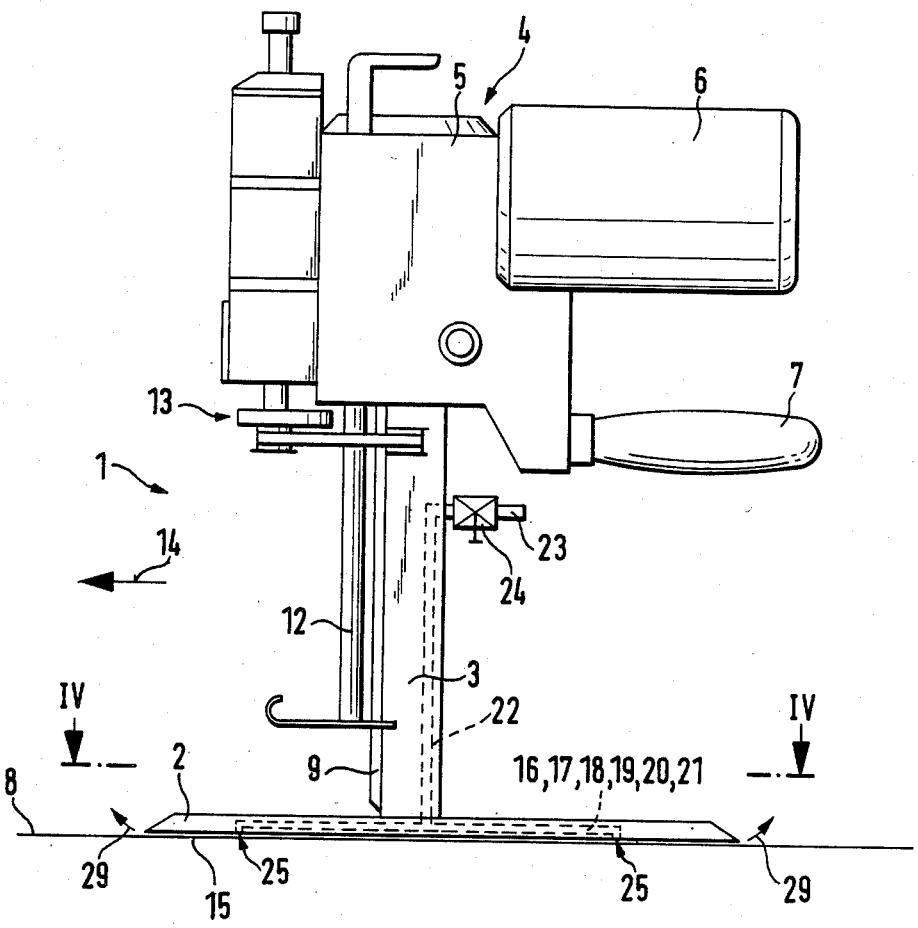
FIG. 1 shows a side view of a manual fabric cutting machine.
Figure 4:
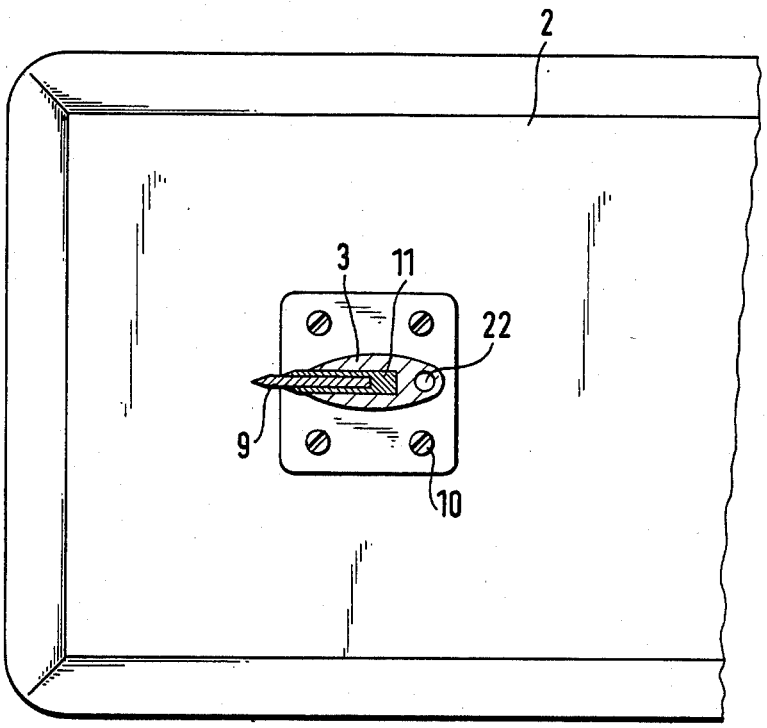
FIG. 4 is a section taken on the line IV—IV in FIG. 1.

The machine 1 shown in FIG. 1 is a manually displaceable machine for cutting out fabric. The machine comprises a supporting foot 2, an upwardly directed column 3 of elliptical cross-section, which is secured substantially centrally on the supporting foot 2, and a cutting unit 4 carried by the column 3. The cutting unit 4 comprises a gear housing 5 upon which a driving motor 6 and a handle 7 are mounted. The handle 7 is used to shift the machine over a cutting table 8. The column 3 has a thin flange which is received in a recess in the supporting foot 2 and fastened by means of countersunk screws 10.

The gear housing 5 contains a drive mechanism, which is not represented in detail, for a so-called reciprocating blade 9 which along a large part of its width is held fast in a cutter guide 11 which is received in a vertical slot of the column 3. The gear housing also carries a holding- down device 12 for the layers of fabric to be cut (not shown) and a sharpening device 13 for the blade 9.

During cutting, the machine 1 is displaced on the cutting table 8 by hand by the operator in the direction of advance identified by an arrow 14. The supporting foot 2 thereby engages the layers of material from below and these slide over the supporting foot 2.

Six passages 16 to 21 are provided in the supporting foot 2 and extend parallel to its lower face 15. The passages 16 to 21 are in the form of drillings which are arranged in the shape of an H when viewed perpendicular to the face 15 (see FIG. 2). The transverse channels 20, 21 open into a substantially central distributor chamber 30, which is shown only in FIG. 2. A common supply line 22, which extends through the column 3, also opens into the distributor chamber 30. The supply line 22 leads to a connection piece 23 which has a shut-off valve 24 and to which a compressed air line, not shown, may be connected.

Four openings 25 for the channels 16 to 19 are provided in the lower face 15. The openings 25 are formed in round fittings 26 which are recessed into the face 15, and are connected to the channels 16 to 19 by means of radial bores 27. The openings are constituted by the ends of central axial bores of reduced diameter to provide a nozzle 28. The openings 25 lie substantially on the diagonals, not shown, of the quadrangular face 15.

The arrangement of the openings 25 is such that the ratio of the smallest distance a of each opening 25 from the periphery of the face 15 to the distance b between the openings 25 and the centre of gravity or centre of the base 15 is approximately 1:3.6.

During the operation, the shut-off valve 24 is open so that compressed air is able to flow through the channels 16 to 22 to the openings 25. On account of the air pressure, the machine 1 is raised slightly so that the compressed air can emerge from the openings 25 to form a thin air cushion between the lower face 15 and the cutting table 8. Because of this air cushion, there is substantially no frictional contact between the lower face 15 and the table 8. Consequently, the machine 1 can be displaced and turned on the cutting table 8 very easily.

The compressed air emerges from the small gap formed between the face 15 and the cutting table 8 substantially in the direction indicated by arrows 29 at the periphery of the supporting foot 2. If the shut-off valve 24 is closed, the air cushion is reduced and the machine 1 again makes frictional contact with the cutting table 8.

The arrangement is such that the common supply line 22 extends substantially at the center of gravity of the machine 1 and substantially at the center of the lower face 15.

In order to achieve equal flow in the transverse channels 20, 21, it is advantageous to connect the common supply line 22 to the transverse channels 20, 21 by the distributor chamber 30, shown only in FIG. 2.

The embodiment of FIGS. 5 and 6 differs from the first solely because the channels are constituted by hose lines 33 which are arranged in recesses 34 or grooves formed in the face 15. The hose lines 33 are connected to one another by branch pieces 35. The connections to the fittings 26 and to the distributor chamber 30 are effected by means of plug-in connections 36 which, if necessary, can be sealed by means of adhesive. The advantage of this development is that it is simple and easy to produce the compressed air lines. When the supporting foot 2 is made by casting , no metal-cutting work is required to form the compressed air passages. The hose lines 33 can be installed in the rough recesses 34.

I claim:

1. A manually controllable machine for cutting or notching fabric, comprising:

a body;

a blade connected to the body to cut or notch fabric;

a supporting foot connected to the body for supporting the machine on a fabric cutting table, the supporting foot including (i) a flat bottom face, and (ii) a plurality of air outlets in the bottom face;

a central air distribution chamber;

means in fluid communication with the distribution chamber for conducting compressed air thereto; and a plurality of air paths extending between and in fluid communication with the air outlets and the air distribution chamber, each air path being adapted to conduct pressurized air from the distribution chamber to a respective one of the air outlets, all of the air paths having the same, preset length to help equalize the pressure of the air discharged through the respective air outlets.

2. A machine according to claim 1, wherein:

the center of gravity of the machine is on a vertical axis;

the bottom face includes a peripheral edge; and the ratio of the distance between each air outlet and the peripheral edge to the distance between the air outlet and said vertical axis is between approximately 1:2 and 1:4.

3. A machine according to claim 1, wherein:

the bottom face has a quadrangular shape defining first and second diagonals;

the plurality of air outlets include a first, a second, a third and a fourth outlet;

first and second outlets are located substantially on the first diagonal; and the third and fourth outlets are located substantially on the second diagonal.

4. A machine according to claim 1, wherein:

the plurality of air paths extend parallel to the bottom face, and are disposed in the shape of an H having a central cross channel;

the distribution chamber is centrally located in said central cross channel.

5. A machine according to claim 1, further comprising a plurality of fittings, each fitting being recessed in a different one of the air outlets and forming a nozzle.

6. A machine according to claim 1, wherein different fittings have nozzles of different sizes.

7. A machine according to claim 1, wherein:

the body includes an elongated support column connected to and extending upward from the supporting foot; and the means for conducting compressed air into the distribution chamber includes a supply line longitudinally extending inside the support column.

8. A machine according to claim 1, wherein the means for conducting compressed air into the distribution chamber includes a shut-off valve having open and closed positions to control flow of the compressed air through the plurality of air paths.

9. A machine according to claim 1, wherein:

the bottom face includes a recess; and each of the air paths includes a hose or pipe secured in the recess in the bottom face.

10. A machine according to claim 1, wherein:

the center of gravity of the machine is on a vertical axis; and each of the air paths extend from said vertical axis to the respective one of the air outlets.

11. A machine according to claim 10, wherein the plurality of air paths include a plurality of channels extending within the bottom face over the entire lengths of the air paths between the central air distribution chamber and the air outlets.

12. A machine according to claim 11, wherein:

the plurality of channels has an H-shape, including (i) a central cross channel having first and second ends, and (ii) first and second legs in communication with the first and second ends, respectively, of the cross channel and extending perpendicular thereto, the central air distribution chamber is located on said vertical axix and in said cross channel, equidistant between the first and second ends thereof;

each of said first and second legs includes a first and a second and;

the plurality of air outlets includes a first, a second, a third, and a fourth outlet; and the first outlet is located at the first end of the first leg, the second outlet is located at the second end of the first leg, the third outlet is located at the first end of the second leg, and the fourth outlet is located at the second end of the second leg.

* * * * *